United States Patent [19]

Ecker

[11] Patent Number: 4,604,250

[45] Date of Patent: Aug. 5, 1986

[54] COLUMN FORM SUPPORT SYSTEM AND METHOD

[75] Inventor: Fred L. Ecker, Sierra Madre, Calif.

[73] Assignee: Concrete Systems, Inc., Azusa, Calif.

[21] Appl. No.: 664,481

[22] Filed: Oct. 24, 1984

[51] Int. Cl.[4] ..... B28B 23/18

[52] U.S. Cl. ..... 264/35; 249/23; 249/48; 249/90; 264/31; 264/275

[58] Field of Search ..... 249/23, 24, 30, 42, 249/48, 51, 83, 90, 91, 143, 164; 264/32, 35, 259, 275

[56] References Cited

U.S. PATENT DOCUMENTS

| | | | |
|---|---|---|---|
| 1,936,531 | 11/1933 | Weber | 249/23 |
| 2,335,338 | 11/1943 | Hillberg | 249/42 |
| 3,303,244 | 2/1967 | Talley et al. | 264/32 |
| 3,588,971 | 6/1971 | Lipski | 249/83 |
| 3,705,220 | 12/1972 | Ecker | 249/48 |
| 3,857,540 | 12/1974 | Ecker | 249/48 |
| 4,472,331 | 9/1984 | Kida | 264/35 |

FOREIGN PATENT DOCUMENTS

| | | | |
|---|---|---|---|
| 143007 | 7/1950 | Australia | 249/94 |
| 1072594 | 6/1967 | United Kingdom | 249/42 |

*Primary Examiner*—Jay H. Woo
*Assistant Examiner*—James Housel
*Attorney, Agent, or Firm*—Christie, Parker & Hale

[57] ABSTRACT

A column form support system and method are set forth encasing steel in concrete. Included are support members which are affixed to the steel and extend outwardly therefrom. A concrete form is exerted about the steel, the support members being adjustable to bear against, and support and align the form relative to the steel. Concrete is poured into the form to encase the steel, the support members maintaining the proper alignment of the form. After the concrete has hardened, the form is disassembled.

2 Claims, 4 Drawing Figures

COLUMN FORM SUPPORT SYSTEM AND METHOD

FIELD OF THE INVENTION

This invention relates to construction forms and methods and more particularly it relates to column forms and support systems therefor.

BACKGROUND OF THE INVENTION

In the construction of buildings or other structures, it has long been known to use temporarily erected forms to receive concrete. For example, to fashion a column, a form is erected, perhaps about reenforcing steel bars (rebar) or a solid steel column. Hereinafter, rebar and solid steel members or columns will be collectively referred to as steel. Concrete is poured into the form around the steel and allowed to harden. When the concrete has sufficiently hardened to be self-supporting the form is disassembled, leaving behind the desired concrete column encasing the steel.

A problem encountered with conventional forms is that of locating the forms so as to be properly positioned about the steel and to maintain that position during the pouring of the concrete. Failure to initially obtain or to maintain the correct orientation of the form relative to the steel can result in improper or otherwise unacceptable encasement of the steel within the concrete. For example, the resultant column may be aesthetically unappealing due to undulations in the concrete encasement, the steel may be exposed leading to unappealing rust marks on the concrete column or, from a structural support standpoint, the steel reinforcing bars may be improperly encased and integrated into the column to give the desired supporting characteristics.

To obtain and maintain the proper relationship of the form to the steel, laborious alignment of the form to the steel during assembly of the form is required. Numerous external supporting means must also be used to maintain the form about the steel against the pressure of the concrete when it is poured into the form. As can be appreciated, these prior art techniques have been time consuming, fraught with pitfalls and, particularly from a labor standpoint, expensive.

SUMMARY OF THE INVENTION

There is, therefore, provided in the practice of the present invention, a column form support system which is easily and automatically aligned with the steel to be encased, which maintains the proper, spaced relationship between the steel and the form during the pouring and hardening of the concrete and which dispenses with the need for external supports. With this system, it is believed that substantial savings of labor and material in the construction of columns can be obtained.

Toward this end, the form system includes supports affixed to the steel and extending outwardly therefrom. Form panels are interconnected to each other about the steel to define a form for receiving the concrete. At least one of the supports is arranged to bear against each panel to support and align the form about the steel. When the concrete is poured into the form, the supports are integrated into the concrete to form part of the column itself. When the concrete is hardened the form panels can be disassembled, leaving behind the desired structurally and aesthetically pleasing column.

Each of the supports preferably includes a first member adapted to be affixed to the steel as by welding or the like and a second member which is movably disposed along the first member for adjustment to bear against the form panel. By adjusting the positions of the second members to bear against the panels, the proper orientation of such form panels can be quickly and easily obtained.

Further, by virtue of the supports in effect bracing the form panels against the steel, external supports to maintain alignment of the panels are not required.

More particularly, each support includes the first member such as a stud affixed to the steel and an adapter connected to the first member having an external, threadlike surface. The second member is threaded over the adapter for easy adjustment therealong. The second member may be embodied as a plastic cone the frustrum of which is directed toward the steel and the larger base of which is adapted to bear against the panel. When the concrete is hardened and the forms are disassembled, the conical second member may be unthreaded and removed from the encased adapter and stud for repeated use. The bore left by the removal of the second member may be later filled in with concrete, thereby giving the column the desired appearance.

The method for forming a column according to the present invention consists of affixing outwardly extending supports to the steel and erecting a form about the steel, the form bearing against and supported by the supports to maintain its relationship to the steel. Concrete is poured into the form and allowed to harden. Thereafter, the form is disassembled leaving behind the finished column.

BRIEF DESCRIPTION OF THE DRAWINGS

These and other features and advantages of the present invention will be appreciated as the same becomes better understood with reference to the specification, claims and drawings wherein:

DETAILED DESCRIPTION

Figure 1:
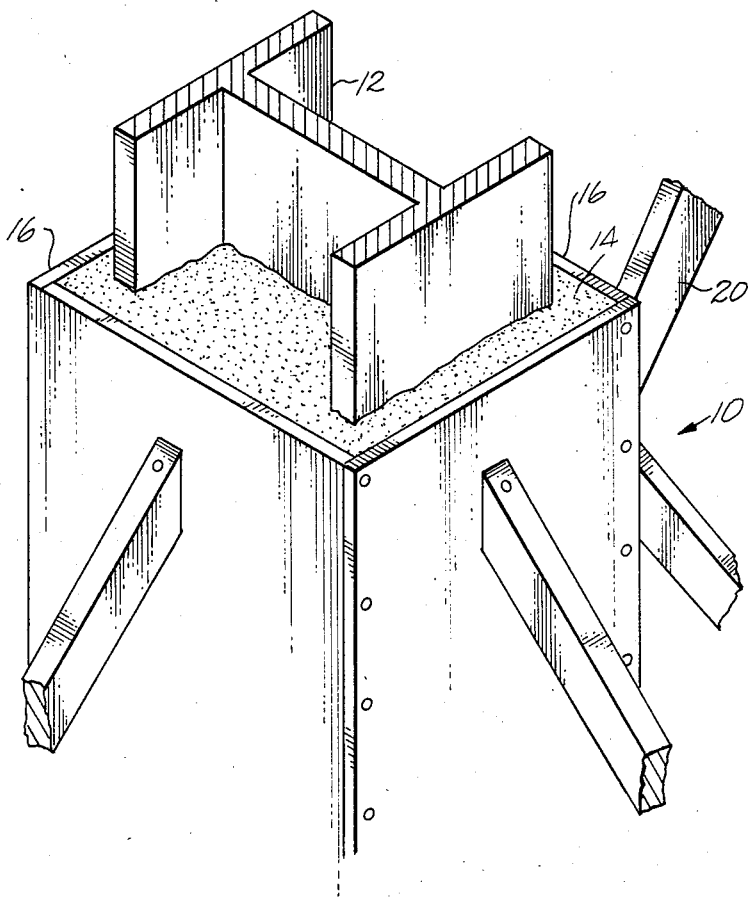
Fig. 1 Prior Art
FIG. 1 is a perspective view of a steel column and concrete form according to the prior art.

Turning to FIG. 1, a form 10 according to the prior art is shown encasing a steel H-column 12. In construction of buildings and the like it may be necessary from a fire protection, aesthetic or structural point of view to encase the H-column 12 in concrete 14. For example, in parking garages encasing the H-column 12 in concrete 14 protects the column from damage by vehicles and provides an aesthetically pleasing and fire protecting casing around the column. It is to be understood that while the following description is directed toward encasement of a steel H-column, the prior art form 10 and the form according to the present invention described hereinafter can also be used for pouring concrete in and about a skeleton of steel reinforcing bars, commonly referred to as rebar, to fashion a load-supporting column or the like.

To encase the H-column 12, the form 10 includes a plurality of upright wooden panels 16 interconnected as by nails 18 to define the desired upstanding shape for the form 10. During assembly of the panels 16 it is important that they remain aligned and spaced from the H-column 12 so that, upon the subsequent pouring of concrete into the form 10, the H-column 12 is properly encased. Subsequent to or during the assembly of the form 10, a plurality of braces 20 are provided, at least one of which bears against each of the panels 16. The braces 20 are connected at one end as by nails 18 to a panel 16, the other ends of the braces 20 being supported against a floor, ceiling, beam or other suitable structure. These braces 20 support the upstanding form 10 to prevent it from shifting relative to the H-column 12 during further assembly of the form and during the pouring of the concrete. The braces 20 must be fashioned and supported so as to maintain the proper alignment of the form 10 about the H-column 12. As can be appreciated, the interconnecting of the panel 16 and the attachment of the braces 20 so as to maintain the aforesaid proper alignment is time consuming and therefore, from a labor standpoint, expensive. Further, from a materials standpoint, the bracing contributes to the expense of using the prior art technique.

After or during assembly and bracing of the form, suitable collars (not shown) are provided about the panels 16 to prevent bursting of the form 10 under the head pressure of the concrete 14 when it is poured into the form 10.

Figure 2:
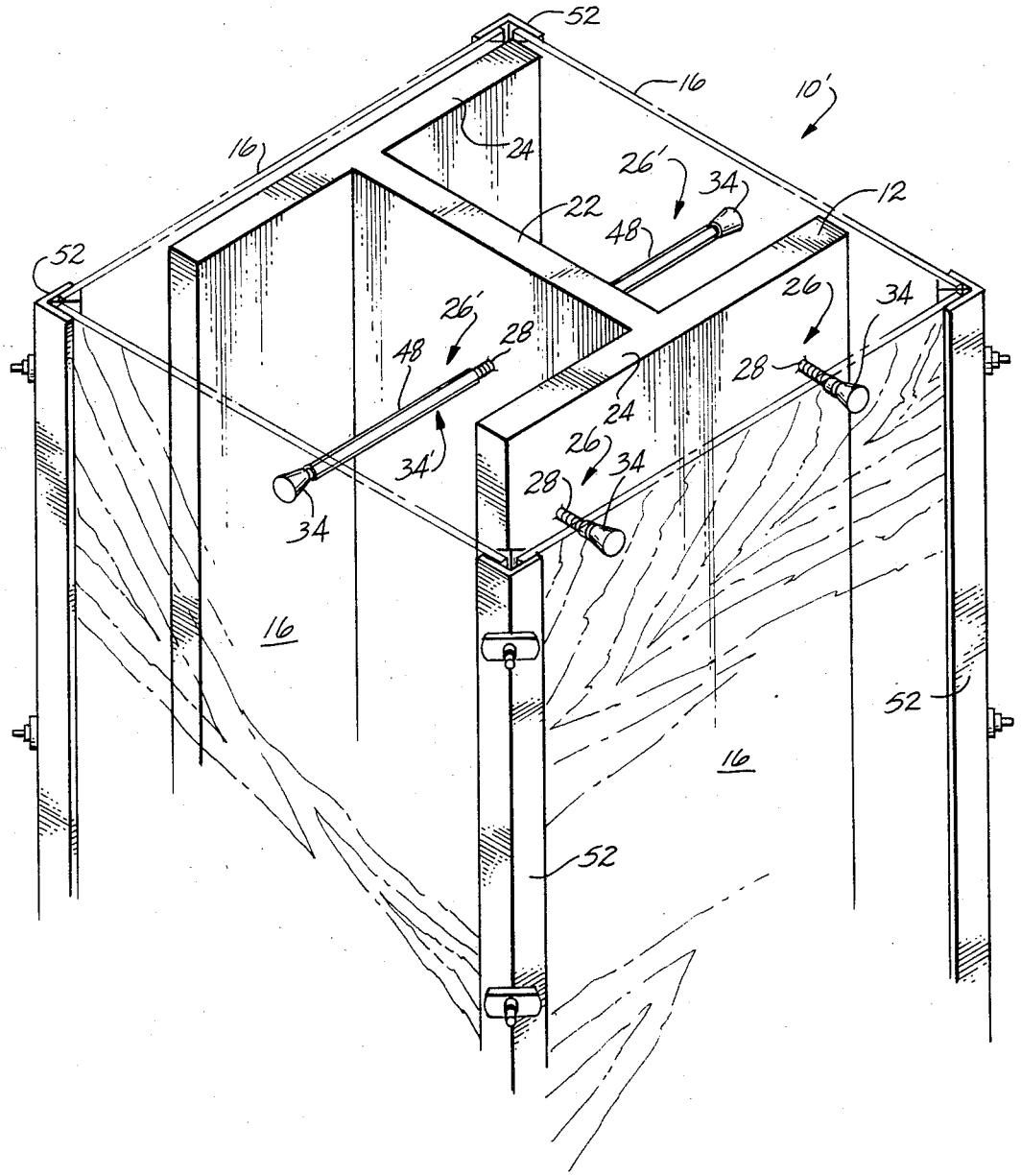
FIG. 2 is a perspective view of a steel column and form according to the present invention.
Figure 3:
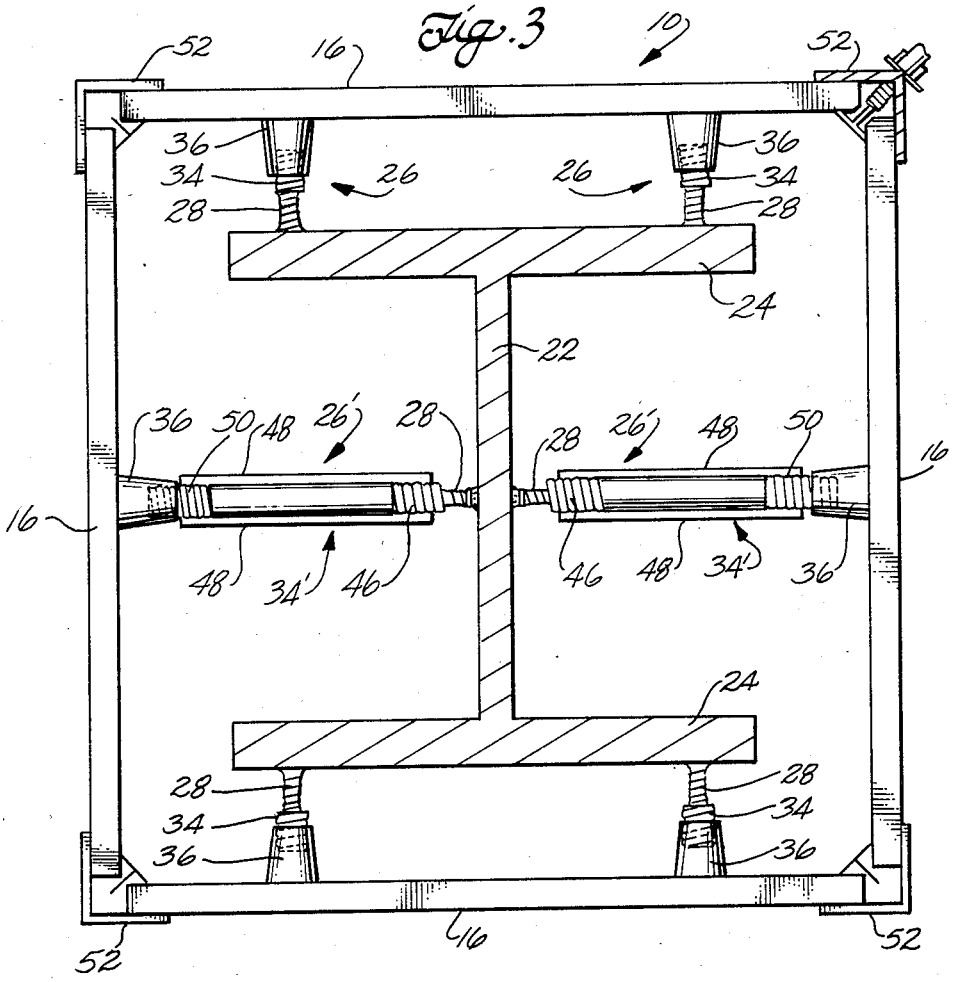
FIG. 3 is a top view of the steel column and form of FIG. 2.

Turning to FIGS. 2 and 3, a form 10' according to the present invention is shown for encasing an H-column 12 in concrete. Again, it is to be understood that the form 10' and method for joining a column as hereinafter set forth can also be used with a rebar skeleton. As shown, the H-column 12 has a web 22 which extends between two flanges 24, all of which extend the length of the column. Typically, the H-column 12 is supported between a floor and an upper beam or ceiling.

Figure 4:
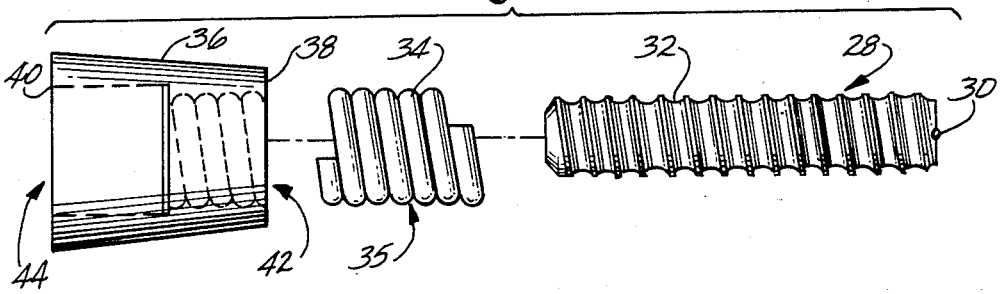
FIG. 4 is an assembly view showing the components and the assembly of the supports which maintain the form about the steel column.

To support and maintain the form 10' about the H-column there is provided at each of the web and flanges at least one support 26 extending outwardly therefrom to bear against the interior surface of the form 10'. Each of the supports 26 at the flanges 24 as shown in FIGS. 2–4 includes a first member embodied as a stud 28. The stud 28 has a flux 30 at one end and outer threads 32. Each stud 28 is metallic and is preferably of the type to be used with an appliance, generally known as a Nelson Stud Gun (not shown) which is manufactured by Nelson Stud Welding Co., a United Carr Division of TRW Inc. Stud Gun, Ser. No. 700279. Also Control Box Ser. No. 8910 by TRW Inc. and is known by those skilled in the art. When the stud 28 is positioned in the gun and is abutted against a metallic object such as the H-column 12, the gun is energized to send current through the stud to melt the flux 30 and weld the stud 28 to the H-column 12. Thereafter the stud 28 is released from the gun, leaving the stud bonded to the H-column.

Disposed about the end of each stud 28 opposite the flange 24 is an adapter 34 fashioned to be threaded over the stud 28. The adapter 34 may be constructed by coiling No. 9 gauge wire in such a manner as to have a suitable internal diameter to be threaded over the stud 28. By virtue of its coiled shape, the adapter 34 presents an outer threaded surface 35.

The stud 28 and adapter 34 therefore provide a fixed structure to withstand compressive forces which may be generated during forming or during pouring. It can be appreciated that in conjunction with the stud and adapter, means are required to adjust the length of the overall support 26 so that each such support, regardless of variances in the length of the stud or adapter or the position of the adapter on the stud, suitably bears against the form 10' to properly position and maintain the form against movement. For this purpose the support 26 includes a second member, preferably embodied as a cone 36 threaded over the adapter 34. As best shown in FIG. 4, the cone 36 is frustroconical, having a frustrum 38 which is directed toward the flange 24 and a larger diameter base 40 to bear against the form 10' as shown in FIGS. 2 and 3. To thread over the adapter 34, the cone 36 has a threaded bore 42 extending from the frustrum 38 axially into the cone 36. The threaded bore 42 terminates at a larger diameter smooth bore 44 which extends therefrom axially through the remainder of the cone to exit at the base 40. The threaded bore 42 extends approximately one-half the axial length of the cone 36 which is sufficient to mount the cone 56 to the adapter 34. Via the adapter 34, the position of the cone 36 can be adjusted, thereby adjusting the overall length of the support 26 so that the base 40 can suitably bear against, support and align the form 10' about the H-column 12. Further, the cone 36 can be unthreaded from the adapter 34 for removal upon completion of the column.

As shown in FIGS. 2 and 3, supports 26 as set forth above are provided at each of the flanges 24, the supports 26 extending outwardly to bear against the form 10'. At the web 22, however, it can be appreciated that the support 26 must be fashioned to extend a greater distance than those at the flanges 24. Accordingly, these modified supports, hereinafter referred to as supports 26', include adapters 34' having a length greater than that of adapters 34. Each of the supports 26' includes a stud 28 welded to the web 22 in the manner described above. The adapter 34' is threaded over the outer threads 32 of the stud 28 also in the manner described above, and may be embodied in its entirety as a long wire coil like that described above with reference to FIG. 4. Alternatively, the adapter 34' may be as shown in FIGS. 2 and 3 including a first coil portion 46 of coil wire similar to that shown in FIG. 4 and threaded over the stud 28. Extending from the first coil portion 46, the adapter 34' includes a pair of rods 48 welded or otherwise suitably bonded to the first coil portion 46 and extending outwardly from the web 22 to mount between their respective ends a second coil portion 50. The second coil portion 50 extends outwardly from the rods 48 to mount the cone 36 in the manner described above. Accordingly, in effect, the rods 48 act as extensions to extend the overall length of the adapter 34'.

The supports 26 and 26' are disposed at intervals along the length of the H-column 12. Preferably, the supports are grouped to support the upper and lower ends of the form 10' and are grouped at locations therebetween as determined for the proper support and alignment of the form. Once the supports 26 and 26' have been secured to the H-column 12, the cones 36 are adjusted to align with their counterparts in other groupings of supports along the length of the H-column 12. In other words, the cones 36 of the supports 26 at the H-column flanges 24 are adjusted such that their bases 40 are arranged to be co-planar with those supports positioned above and/or below those particular supports 26.

The form 10' may be of the type as previously described or may be of the type as set forth in U.S Pat. Nos. 3,705,220 and 3,857,540, the disclosures of which are hereby incorporated by reference. These types of forms include panels 16 joined by attaching angles 52 providing for a form which can quickly and easily be erected.

As can be appreciated by virtue of the supports 26, the form during assembly, and more particularly its panels 16, are arranged to abut and bear against the cones of corresponding supports 26 or 26'. In this manner the panels 16 are properly aligned and spaced from the H-column 12 to assure proper encasement of the column in concrete. By virtue of the supports 26 and 26', the form 10' is easily supported during assembly, and is automatically aligned and supported relative to the H-column 12. Should the form 10' be urged during assembly or during the pouring of concrete into the form to be displaced relative to the H-column 12, the supports 26 and 26' prevent such displacement. Therefore, external supports for forms heretofore necessary to prevent such displacement can be dispensed with. This, in turn, translates into a cost savings, for casting such encasing concrete columns.

After the form 10' has been assembled about the H-column 12 and the supports 26 and 26', exterior collars are applied about the form to prevent the form 10 from bursting under the head pressure of the concrete. These collars (not shown), by virtue of the supports 26 and 26', need not be exteriorly supported and need only be secured about the form 10'. Once the supports 26, 26' have been positioned and the form 10, 10' has been erected, concrete is poured into the form about the H-column and is allowed to harden. During pouring and hardening of the concrete, the form 10, 10' cannot shift or move, in that the supports 26, 26' bear against the inside of the form 10, 10'. After the concrete is sufficiently hard to be self-supporting, the collars are removed and the form 10, 10' is disassembled, leaving behind the desired concrete, steel encasing column.

To finish the concrete column the cones 36 are unthreaded from their adapters 34, 34'. The frustroconical shape of the cone prevents it from becoming encased in the concrete with its counterparts, the stud and adapter. Removal of the cones leaves frustroconical bores in the column which can be filled with cement or grout, giving the column an aesthetically pleasing appearance.

While I have shown and described certain embodiments of the present invention, it is to be understood that it is subject to many modifications without departing from the spirit and scope of the appended claims. For example, the cone could be threaded directly to the studs.

What is claimed is:

1. A form about an upstanding column for receiving concrete including:

interconnected form panels disposed about said column to define a form to receive concrete; and means for supporting and adjustably spacing the panels about the column without attachment thereto, the supporting means including, at least one stud affixed to and projecting from the column to support a corresponding form panel, and a bearing member removably coupled to and adjustably positionable at the end of each stud, each bearing member having a base spaced from the column, the bearing member bases at each side of the column arranged to be coplanar, said form panels bearing against the bearing member bases to support the panels in the planes defined by said bases.

2. A method for forming a concrete column encasing a steel member comprising in sequence:

attaching at least one stud to the steel member to project outwardly from the member to support a corresponding form panel;

detachably coupling a bearing member at the end of each stud, each bearing member including a base remote from the member;

positioning the bearing members at each side of the steel member to a position whereat the bases are coplanar;

erecting form panels to disconnectedly bear against said bases without attachment thereto to define a form, the panels aligned into the planes defined by the member bases;

pouring concrete into said form comprised of the form panels supported by, but not attached to the bearing members, to encase the steel member, studs and bearing members; and disassembling said form panels when the concrete has hardened and removing said bearing members for reuse.

* * * * *